US006281667B1

(12) United States Patent
Matsumura

(10) Patent No.: US 6,281,667 B1
(45) Date of Patent: Aug. 28, 2001

(54) VOLTAGE REGULATOR

(75) Inventor: Atsuko Matsumura, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/652,189

(22) Filed: Aug. 31, 2000

(30) Foreign Application Priority Data

Sep. 6, 1999 (JP) ..... 11-251605
Feb. 7, 2000 (JP) ..... 12-028794

(51) Int. Cl.[7] ..... G05F 1/565
(52) U.S. Cl. ..... 323/274; 323/280; 323/284
(58) Field of Search ..... 323/273, 274, 323/275, 280, 282, 284, 285; 307/85, 86

(56) References Cited

U.S. PATENT DOCUMENTS 5,578,960 * 11/1996 Matsumura et al. ..... 323/280 X
5,828,208 * 2/2001 Oka ..... 323/282
6,188,212 * 2/2001 Larson et al. ..... 323/274 X

FOREIGN PATENT DOCUMENTS 2000-235422 * 8/2000 (JP) .

* cited by examiner

*Primary Examiner*—Jessica Han
(74) *Attorney, Agent, or Firm*—Adams & Wilks

(57) ABSTRACT

In a reference voltage circuit 2 and an error amplifier 3 in a voltage regulator, a power supply is taken from an input voltage Vdd when an output voltage Vout is lower than an arbitrary set output voltage Vo and from the output voltage Vout when the output voltage Vout is higher than an arbitrary set output voltage Vo, to thereby largely suppress a noise contained in the input voltage from reflecting the output voltage Vref of the reference voltage circuit, etc.

1 Claim, 3 Drawing Sheets

VOLTAGE REGULATOR

BACKGROUND OF THE INVENTION

1. Field of the Invention

The present invention relates to a voltage regulator capable of improving the removal ratio of ripples of a voltage regulator.

2. Description of the Related Art

There has been known a conventional voltage regulator as shown in a circuit diagram of FIG. 5. That is, the conventional voltage regulator is made up of a voltage regulator control circuit including an error amplifier 3 that amplifies a differential voltage between a reference voltage Vref outputted from a reference voltage circuit 2 and a voltage at a node of breeder resistors 6 and 7 which divide a voltage (hereinafter referred to as "output voltage") Vout at an output terminal 10 of the voltage regulator, and an output transistor 5.

Assuming that the output voltage of the error amplifier 3 is Verr, the output voltage of the reference voltage circuit 2 is Vref, the voltage at the node of the breeder resistors 6 and 7 is Va, if Vref>Va, Verr becomes low whereas if Vref<Va, Verr becomes high.

If Verr becomes low, since a voltage between a gate and a source of an output transistor 5, in this case, a p-channel MOS transistor becomes large, an on-resistance becomes small, and the output voltage Vout is raised. On the contrary, if Verr becomes high, the on-resistance of the output transistor 5 is made high, and the output voltage Vout drops, to thereby maintain the output voltage Vout at a constant value.

In general, in case of the voltage regulator, since the output voltage Vout is lower than a desired voltage at the time of starting, in order to raise the output voltage, control is made so that the output Verr of the error amplifier 3 becomes minimum, and the on-resistance of the output transistor 5 becomes very small.

However, because the conventional voltage regulator always takes the power supply of the reference voltage circuit and the error amplifier from Vdd which is an input voltage, if some noise is contained in the input voltage Vdd, the noise of the input power supply is also generated in the voltage Vref outputted from the reference voltage circuit which uses the input voltage Vdd as a power supply and the voltage Verr outputted from the error amplifier. If the noise is contained in the Vref and Verr, a noise is also generated in the output voltage Vout of the voltage regulator, thereby leading to such a problem that the removal ratio of ripples is deteriorated.

SUMMARY OF THE INVENTION

Under the above circumstances, in order to solve the above problem with the conventional voltage regulator, an object of the present invention is to prevent a noise from being generated in an output voltage Vref of a reference voltage circuit, an output voltage Verr of an error amplifier and a final output voltage Vout of a voltage regulator in response to a noise of an input power supply, by taking at least any power supply of the reference voltage circuit and the error amplifier from a voltage Vdd of the input power supply when the output voltage Vout of the voltage regulator is lower than an arbitrary set output voltage Vo and from the output voltage Vout of the voltage regulator when the output voltage Vout is higher than an arbitrary set output voltage Vo.

In order to solve the above problem, according to the present invention, a power supply of the reference voltage circuit and the error amplifier in the voltage regulator is taken from the voltage Vdd of the input power supply when the output voltage Vout of the voltage regulator is lower than an arbitrary set output voltage Vo and from the output voltage Vout of the voltage regulator when the output voltage Vout of the voltage regulator is higher than an arbitrary set output voltage Vo, thereby being capable of preventing a noise contained in the input power supply from reflecting the output voltage Vref of the reference voltage circuit, and the output voltage Verr of the error amplifier and also adversely affecting the output voltage Vout of the voltage regulator, to obtain the high removal ratio of ripples.

BRIEF DESCRIPTION OF THE DRAWINGS

These and other objects, features and advantages of this invention will become more fully apparent from the following detailed description taken with the accompanying drawings in which.

DETAILED DESCRIPTION OF THE PREFERRED EMBODIMENTS

At least any power supply of a reference voltage circuit and an error amplifier in a voltage regulator is taken from a voltage Vdd of an input power supply when an output voltage Vout of the voltage regulator is lower than an arbitrary set output voltage Vo and from the output voltage Vout of the voltage regulator when the output voltage Vout of the voltage regulator is higher than an arbitrary set output voltage Vo, thereby being capable of preventing a noise contained in the input power supply from reflecting the output voltage Vref of thereference voltage circuit or the output voltage Verr of the error amplifier and also the output voltage Vout of the voltage regulator from fluctuating.

Now, a description will be given in more detail of a preferred embodiment of the present invention with reference to the accompanying drawings.

Figure 1:
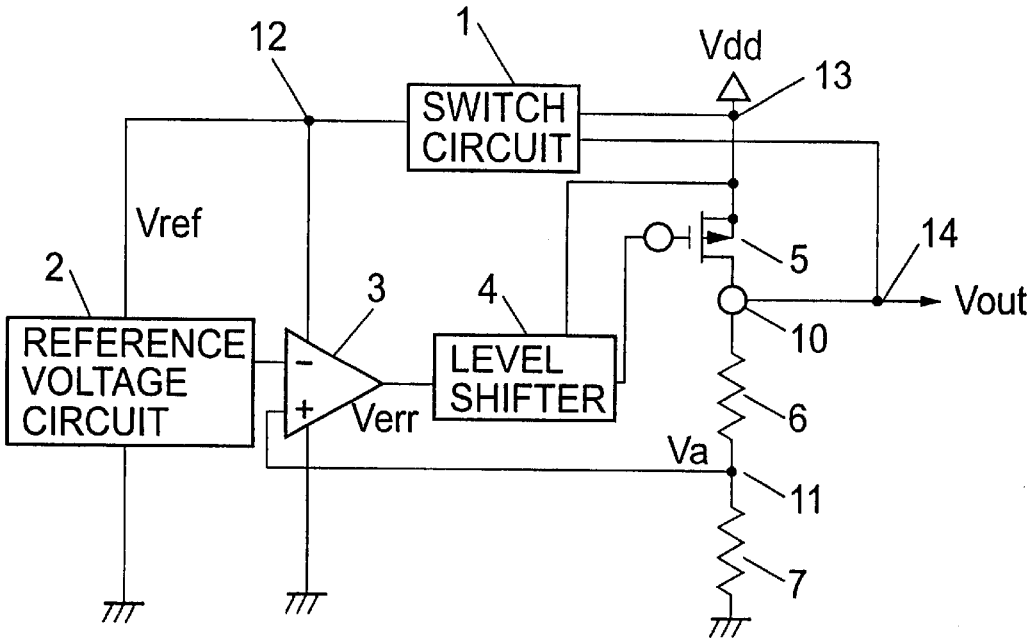
FIG. 1 is an explanatory diagram showing a voltage regulator circuit in accordance with a first embodiment of the present invention.

FIG. 1 is a diagram showing a voltage regulator circuit in accordance with a first embodiment of the present invention. In the figure, a reference voltage circuit 2, breeder resistors 6, 7, an error amplifier 3 and an output transistor 5 are identical with those in the conventional voltage regulator.

Power supplies of the reference voltage circuit 2 and the error amplifier 3 are connected with an output voltage from a switching circuit 1. An output of the error amplifier 3 is connected with an input of a level shifter 4, and an output of the level shifter 4 is connected with a gate of an output transistor 5.

Figure 2:
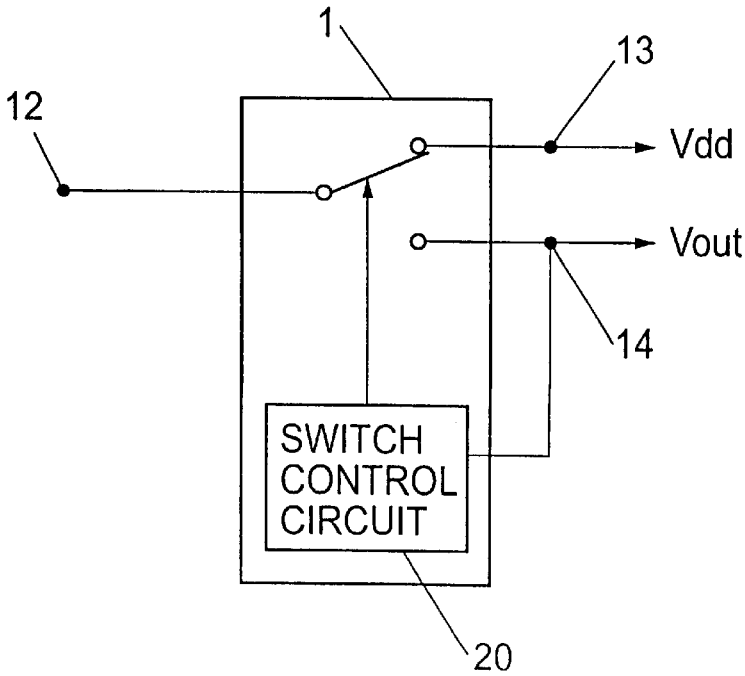
FIG. 2 is a schematic diagram showing a switching circuit 1 in accordance with the first embodiment of the present invention.

An internal circuit of the switching circuit 1 is schematically shown in FIG. 2. The specific operation of the switching circuit 1 is made by the operation of a switch control circuit 20 in such a manner that the power supplies of the reference voltage circuit 2 and the error amplifier 3 are taken from a voltage Vdd of an input power supply when an output voltage Vout of the voltage regulator is lower than an arbitrary set output voltage Vo, and the power supplies of the reference voltage circuit 2 and the error amplifier 3 are taken from the output voltage Vout when the output voltage Vout of the voltage regulator is higher than an arbitrary set output voltage Vo. This operation is shown in FIGS. 3A and 3B.

Figure 3A:
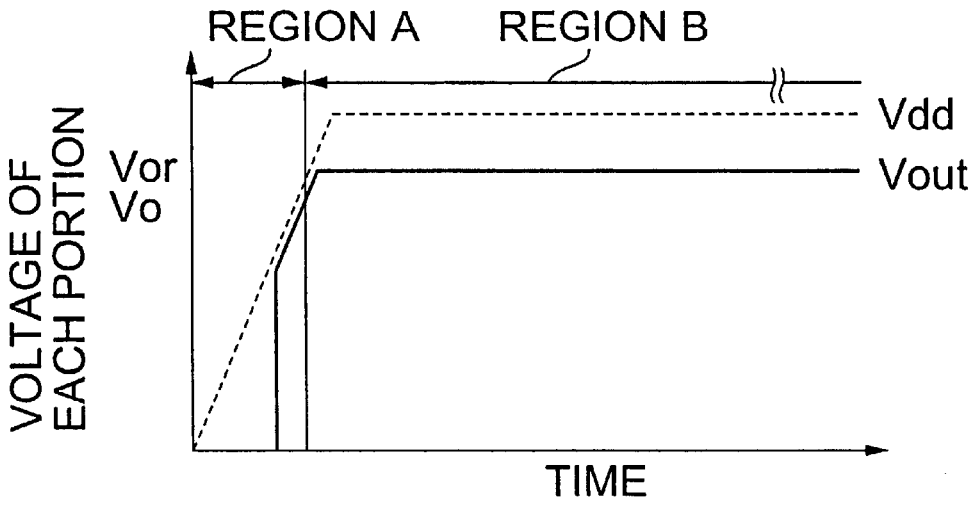
FIGS. 3A and 3B are explanatory diagrams showing the operation of the switching circuit of the voltage regulator in accordance with the present invention.

FIG. 3A shows a state of the output voltage Vout of the voltage regulator with respect to the input supply voltage Vdd. In the figure, a dotted line is representative of the input supply voltage Vdd, and a solid line is representative of the output voltage Vout. As the input supply voltage Vdd is raised, the output voltage Vout of the voltage regulator is also raised and thereafter stabilized when the output voltage Vout reaches an output voltage Vor of the voltage regulator. In this example, a period of time before the output voltage Vout of the voltage regulator reaches the arbitrarily set output voltage Vo which is lower than the output voltage Vor is a region A, and a period of time after the output voltage Vout reaches the arbitrarily set output voltage Vo is a region B.

Figure 3B:
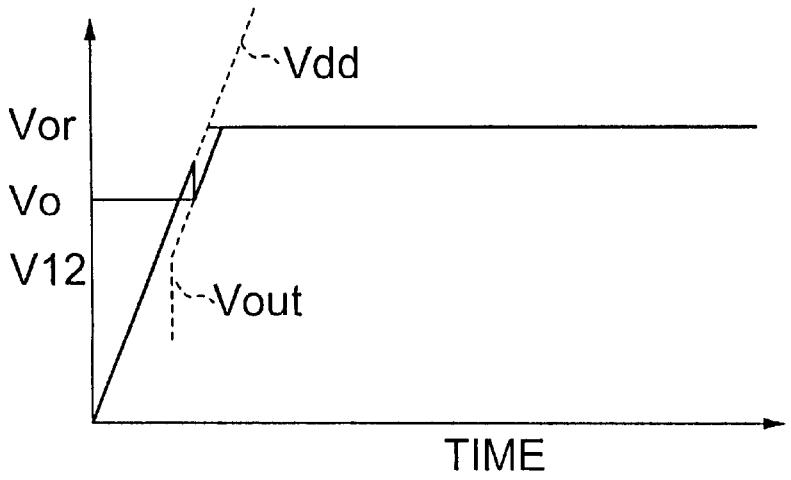

FIG. 3B shows a voltage V12 of a terminal 12 which is a voltage source outputted from the switching circuit and supplied to the reference voltage circuit 2 and the error amplifier 3. In this example, the switching circuit 1 outputs, to the terminal 12 which is an output of the switching circuit 1, the input voltage Vdd in the region A before the output voltage Vout reaches the output voltage Vo and the output voltage Vout in the region B after the output voltage Vout reaches the output voltage Vo.

Figure 4:
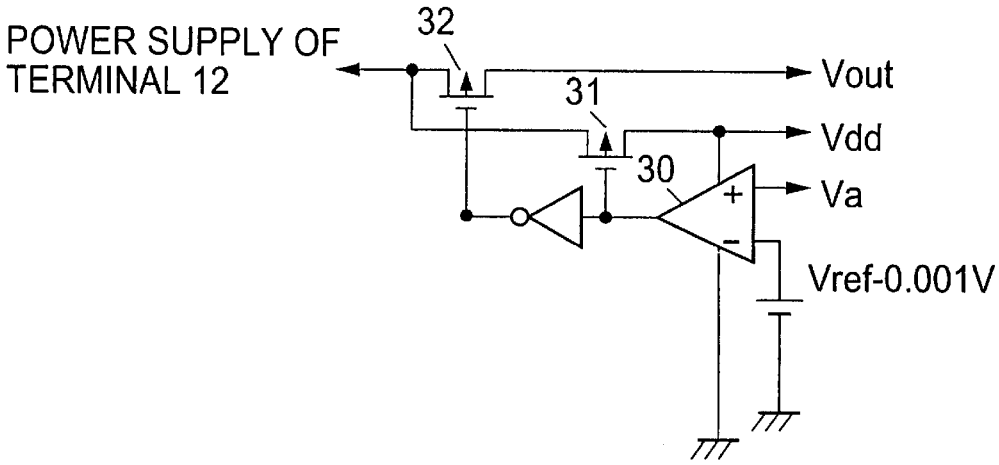
FIG. 4 is a diagram showing a specific example of the switching circuit 1 in accordance with the first embodiment of the present invention.
Figure 5:
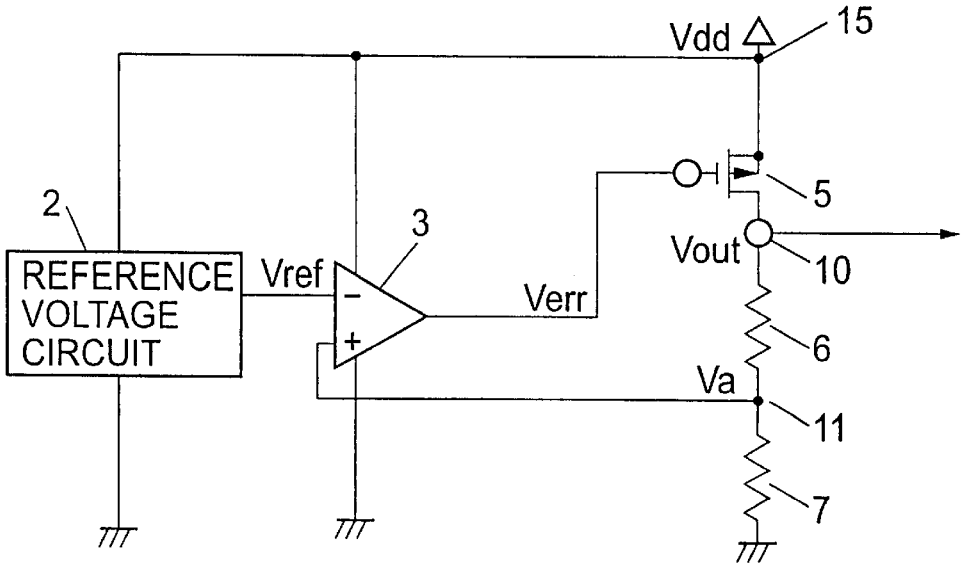
FIG. 5 PRIOR ART
FIG. 5 is an explanatory diagram showing a conventional voltage regulator circuit.

A specific circuit example of the switching circuit 1 is shown in FIG. 4. A plus input of the comparator 30 is inputted with a divided output voltage Va of breeder resistors and a minus input of the comparator 30 is inputted with a voltage lower than the reference voltage output Vref, for example, Vref−0.001 V. When the voltage Va is lower than Vref−0.001, the output of the comparator 30 becomes "L", and a switch Tr 31 connected to the voltage Vdd turns on so that the voltage Vdd becomes the power supplies of the reference voltage circuit and the error amplifier. On the contrary, when the voltage Va is higher than Vref−0.001, the output of the comparator 30 becomes "H", and a switch SW Tr 32 connected to the voltage Vout turns on so that the voltage Vout becomes the power supplies of the reference voltage circuit and the error amplifier.

That is, in the circuit of FIG. 4, an arbitrary set output voltage Vo is as follows:

$$Vo=((R1+R2)/R2))\times(Vref-0.001)$$

When the output voltage Vout<((R1+R2)/R2))×(Vref−0.001), the voltage Vdd becomes the power supplies of the reference voltage circuit and the error amplifier.

On the contrary, when the output voltage Vout>((R1+R2)/R2))×(Vref−0.001), the voltage Vout becomes the power supplies of the reference voltage circuit and the error amplifier.

In the circuit of FIG. 4, the set output voltage Vo that switches the power supplies of the reference voltage circuit and the error amplifier can be adjusted by adjusting the voltage of the power supply connected to the comparator 30.

Now, an expression pertaining to the voltage Vout is obtained as follows:

$$Vout=((R1+R2)/R2))\times Vref \quad (1)$$

Since (R1+R2)/R2 in the expression (1) is a constant, if á is substituted for (R1+R2)/R2, the following expression is obtained.

$$Vout=\acute{a}\times Vref \quad (2)$$

Consequently, it is found that the output voltage Vout is proportional to the reference voltage output Vref, and the output voltage Vout is influenced by the fluctuation of Vref.

In the case where the switching circuit is not provided in the conventional voltage regulator, if some noise is contained in the input power supply voltage Vdd, the noise is also generated in the output Vref of the reference voltage circuit, and the noise is also generated in the voltage Vout as is apparent from the expression (2).

Consequently, a stabilized voltage source less in the noise is desirable as the voltage source of the reference voltage circuit, and the removal ratio of ripples of the voltage regulator can be improved by taking the power supplied of the reference voltage circuit 2 and the error amplifier 3 from the stabilized output voltage Vout after the output voltage Vout reaches the arbitrarily set output voltage Vo.

In the above description, both the power supplies of the reference voltage circuit and the error amplifier are switched. However, even if any one power supply is switched, there is the effect of improving the removal ratio of ripples. In the case where the power supply of only the reference voltage circuit is taken from the output of the switching circuit 1, the level shifter 4 shown in FIG. 1 is not required.

Since the voltage regulator of the present invention selects the power supplies of the reference voltage circuit and the error amplifier from any one of the input supply voltage Vdd and the output voltage Vout by the switching circuit, there are such an advantage that the removal ratio of ripples of the voltage regulator can be improved.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A voltage regulator, comprising: at least an error amplifier, a reference voltage circuit and an output transistor, wherein if an output voltage of said voltage regulator is lower than an arbitrarily set voltage which is lower than said output voltage, an input voltage is used as a power supply for either said reference voltage circuit or said error amplifier, and if said output voltage is higher than said arbitrarily set voltage, said output voltage is used as a power supply for either said reference voltage circuit or said error amplifier.

* * * * *